US011122362B2

(12) United States Patent
I

(10) Patent No.: US 11,122,362 B2
(45) Date of Patent: Sep. 14, 2021

(54) SPEAKER EARPHONE

(71) Applicants: Timon Y. C. I, Brooklyn, NY (US); Kim Wai Chau, Hong Kong (HK)

(72) Inventor: Hou Fai I, Hong Kong (HK)

(73) Assignees: Timon Y. C. I, New York, NY (US); Kim Wai Chau, Hong Kong (HK)

( * ) Notice: Subject to any disclaimer, the term of this patent is extended or adjusted under 35 U.S.C. 154(b) by 22 days.

(21) Appl. No.: 16/789,397

(22) Filed: Feb. 12, 2020

(65) Prior Publication Data

US 2020/0275197 A1 Aug. 27, 2020

(30) Foreign Application Priority Data

Feb. 21, 2019 (CN) ..... 201920232137.8

(51) Int. Cl.
*H04R 3/12* (2006.01)
*H04R 1/40* (2006.01)
*H04R 1/10* (2006.01)

(52) U.S. Cl.
CPC ..... *H04R 1/403* (2013.01); *H04R 1/1075* (2013.01); *H04R 3/12* (2013.01)

(58) Field of Classification Search
CPC . H04R 1/10; H04R 1/40; H04R 1/403; H04R 1/1075; H04R 1/323; H04R 3/00; H04R 3/12
See application file for complete search history.

(56) References Cited

U.S. PATENT DOCUMENTS 2,832,828 A * 4/1958 Levy ..... H04R 3/14 381/98
4,638,505 A * 1/1987 Polk ..... H04S 3/00 381/300
4,961,226 A * 10/1990 Saffran ..... H04R 1/02 381/303
10,602,259 B1 * 3/2020 Huang ..... H04R 1/1066
2005/0226441 A1 * 10/2005 Tanaka ..... H04R 3/14 381/99
2009/0222227 A1 * 9/2009 Gonano ..... H04R 29/00 702/66
2014/0219480 A1 * 8/2014 Collins ..... H04R 3/14 381/300
2017/0164127 A1 * 6/2017 Gautama ..... H04R 3/04

FOREIGN PATENT DOCUMENTS

JP 2016103764 A * 6/2016
KR 200161700 Y1 * 12/1999
KR 102048280 B1 * 1/2020

* cited by examiner

*Primary Examiner* — Thang V Tran

(57) ABSTRACT

The present application discloses a speaker earphone. Each earphone unit includes a first speaker group and/or a second speaker group. The first speaker group includes a first speaker, a second speaker, and at least one capacitor. The second speaker group includes a first speaker, a second speaker, a third speaker, and at least one capacitor. In the present disclosure, at least two speakers are arranged on an enclosure of the earphone. The two speakers are in reverse connection according to polarity in order to achieve a better sound effect.

8 Claims, 4 Drawing Sheets

SPEAKER EARPHONE

CROSS-REFERENCE TO RELATED APPLICATIONS

This application claims the benefit of Chinese Utility Model Patent Application No. 201920232137.8 filed on Feb. 21, 2019, the entire content of which is hereby incorporated by reference.

TECHNICAL FIELD

The present disclosure relates to the technical field of earphones, in particular to a speaker earphone.

BACKGROUND

At present, earphones are a type of personal audio. Nowadays, the requirement for earphones is becoming more and more refined. Choosing the right earphones for different occasions has become a symbol of trendy life. earphones are classified according to their transduction types, which mainly include dynamic type, balanced armature type, electrostatic type, and isomagnetic type. For classification by structural separation, they can be divided into semi-open and closed types. For classification by wearing style, they include earplug style, on-ear style, in-ear style, and headband style. Although there are many types of dual earphones on the market, most dual-unit earphones are simply designed to fix with two speakers. The current dual-unit earphones are prone to change in sound quality when used for a long time, thereby affecting the sound effect.

SUMMARY

In order to overcome the shortcomings of the prior art, an object of the present disclosure is to provide a speaker earphone, which can solve the problem of poor sound effect of the prior art.

The purpose of the present disclosure can be achieved by the following technical solutions:

A speaker earphone includes at least one earphone unit, each earphone unit including a first speaker group and/or a second speaker group, the first speaker group including a first speaker, a second speaker, and at least one capacitor, and the second speaker group including a first speaker, a second speaker, a third speaker, and at least one capacitor;

in the first speaker group, the first speaker and the second speaker are connected in series to form a series branch, or the first speaker and the second speaker are in reverse-parallel connection to form a parallel branch; one end of the series branch is connected to one end of an output signal through the capacitor, another end of the output signal is connected between the first speaker and the second speaker, another end of the series branch is connected to the one end of the output signal; or the parallel branch is connected to both ends of the output signal, and the capacitor is connected between a positive pole of the first speaker and a negative pole of the second speaker in the parallel branch;

in the second speaker group, the first speaker, the second speaker, and the third speaker are sequentially connected in series to form a series branch, or the first speaker, the second speaker, and the third speaker are sequentially connected in reverse-parallel pairs to form a parallel branch; one end of the series branch is connected to one end of the output signal through the capacitor, another end of the output signal is connected between the first speaker and the second speaker, another end of the series branch is connected to the one end of the output signal; or the parallel branch is connected to both ends of the output signal, and the capacitor is connected between a positive pole of the first speaker and a negative pole of the second speaker, or the negative pole of the second speaker and a positive pole of the third speaker in the parallel branch.

Preferably, the number of the earphone unit is one.

Preferably, the number of the capacitor in the earphone unit is one.

Preferably, in the first speaker group, when the first speaker and the second speaker form the series branch, a sound playing direction of the first speaker and a sound playing direction of the second speaker are the same.

Preferably, in the first speaker group, when the first speaker and the second speaker are inversely connected to form the parallel branch, a sound playing direction of the first speaker and a sound playing direction of the second speaker are the same orientation or opposite orientation.

Preferably, in the second speaker group, when the first speaker, the second speaker and the third speaker are sequentially connected in series to form the series branch, a sound playing direction of the first speaker, a sound playing direction of the second speaker, and a sound playing direction of the third speaker are all the same.

Preferably, in the second speaker group, when the first speaker, the second speaker and the third speaker are sequentially connected in reverse-parallel in pairs to form the parallel branch, a sound playing direction of the first speaker, a sound playing direction of the second speaker, and a sound playing direction of the third speaker are all the same orientation or opposite orientation.

Compared with the prior art, the beneficial effect of the present invention is:

In the present disclosure, two or more speakers are provided on an enclosure of the earphone, and the speakers are reversely arranged according to polarity so that a better sound effect can be achieved.

DETAILED DESCRIPTION OF SPECIFIC EMBODIMENTS

The present disclosure is further described below with reference to the drawings and specific embodiments.

The present disclosure provides a speaker earphone, which can improve the structure of the existing earphone by adding a speaker to the enclosure of the existing earphone to form a dual-speaker structure. The two speakers are connected in opposite polarity on the circuit.

The speaker earphone of the present disclosure includes at least one earphone unit. Each embodiment of the present disclosure is described by taking one earphone unit as a preferred embodiment.

Embodiment 1

Figure 1:
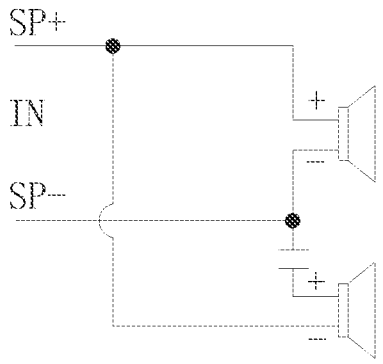
FIG. 1 is a circuit structure diagram according to a first embodiment of the present disclosure.

As shown in FIG. 1, each earphone unit in the present embodiment may include a first speaker, a second speaker, and a capacitor C. The number of the capacitor C may be one or more. In this embodiment, one capacitor is preferred. The first speaker and the second speaker are connected in series to form a series branch. One end of the series branch may be connected to one end (SP+) of an output signal through the capacitor, and another end (SP−) of the output signal may be connected between the first speaker and the second speaker, and another end of the series branch may also be connected to the one end (SP+) of the output signal.

In addition, when the first speaker and the second speaker form the series branch, a sound playing direction of the first speaker and a sound playing direction of the second speaker may be the same.

The method of capacitor connection of the present embodiment is one of the preferred solutions. The capacitor can also be omitted. Assuming that one end of the series branch is connected to one end of the output signal, and the other end is connected to another speaker which is the first speaker, then the capacitor can also be connected between the second speaker and one end (SP+) of the output signal.

Embodiment 2

Figure 2:
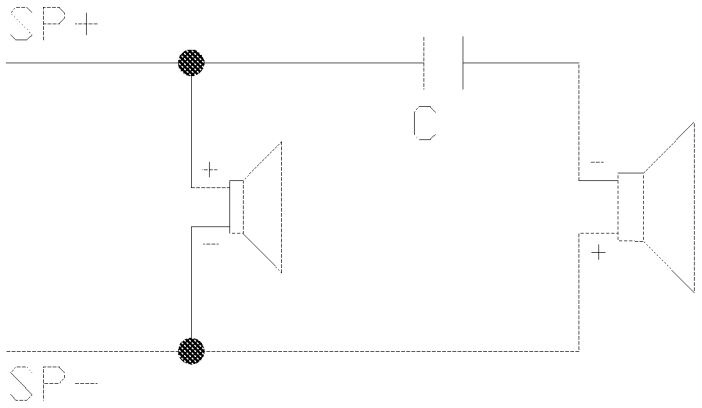
FIG. 2 is a circuit structure diagram according to a second embodiment of the present disclosure.

As shown in FIG. 2, the difference between the first and second embodiments of the present disclosure is that the first speaker and the second speaker of the present embodiment are in reverse-parallel connection to form a parallel branch. That is, the positive pole of one of the speakers is connected to the negative pole of the other speaker. The number of the capacitor in the present embodiment is also preferred to be one. The capacitor may be connected between a positive pole of the first speaker and a negative pole of the second speaker in the parallel branch. The parallel branch can be connected to both ends (SP+, SP−) of the output signal.

The naming of the first speaker and the second speaker in the embodiments are to distinguish the two speakers, but they are not specifically limited to a certain one of the speakers. That is, the capacitor can actually be connected between the negative pole of the first speaker and the positive pole of the second speaker.

In the present embodiment, the first speaker and the second speaker are in reverse connection to form the parallel branch. The sound playing direction of the first speaker and the sound playing direction of the second speaker may be the same.

Embodiment 3

Figure 3:
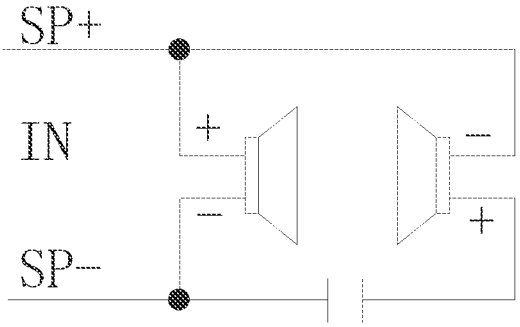
FIG. 3 is a circuit structure diagram according to a third embodiment of the present disclosure.

As shown in FIG. 3, the only difference between the present embodiment and the second embodiment is that the first speaker and the second speaker are inversely connected to form the parallel branch. The sound playing direction of the first speaker is opposite to the sound playing direction of the second speaker. According to the second and third embodiments, it can be seen that when the first speaker and the second speaker are connected in parallel, the sound playing directions of the two speakers may be the same orientation or opposite orientation.

Embodiment 4

Figure 4:
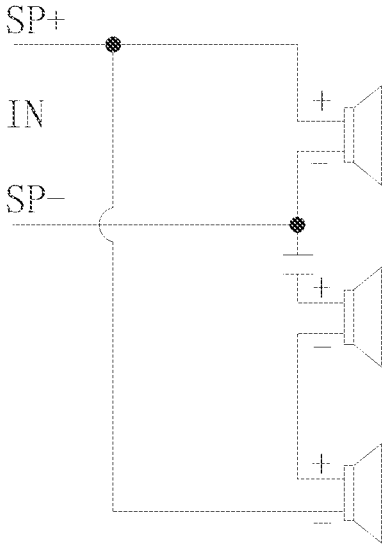
FIG. 4 is a circuit structure diagram according to a fourth embodiment of the present disclosure.

As shown in FIG. 4, each earphone unit in the present embodiment may include a first speaker, a second speaker, and a third speaker. The first speaker, the second speaker, and the third speaker may be sequentially connected in series to form a series branch.

One end of the series branch may be connected to one end (SP+) of an output signal through the capacitor. Another end (SP−) of the output signal may be connected between the first speaker and the second speaker. Another end of the series branch may also be connected to the one end (SP+) of the output signal.

Furthermore, when the three speakers in the present embodiment form a series branch, the sound playing directions of the three speakers may be the same.

Embodiment 5

Figure 5:
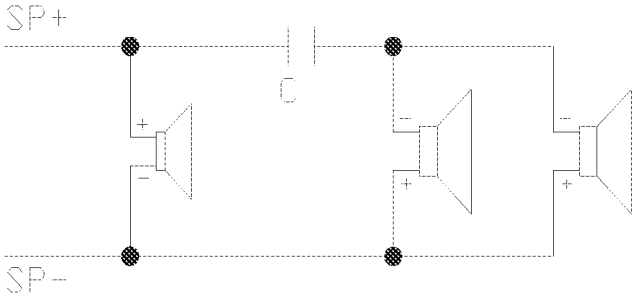
FIG. 5 is a circuit structure diagram according to a fifth embodiment of the present disclosure.

As shown in FIG. 5, each earphone unit in the present embodiment may include a first speaker, a second speaker, and a third speaker. The first speaker, the second speaker, and the third speaker are sequentially connected in reverse-parallel pairs to form a parallel branch. The parallel branch may be connected to both ends of the output signal. The capacitor may be connected between a positive pole of the first speaker and a negative pole of the second speaker, or the negative pole of the second speaker and a positive pole of the third speaker in the parallel branch.

Embodiment 6

Figure 6:
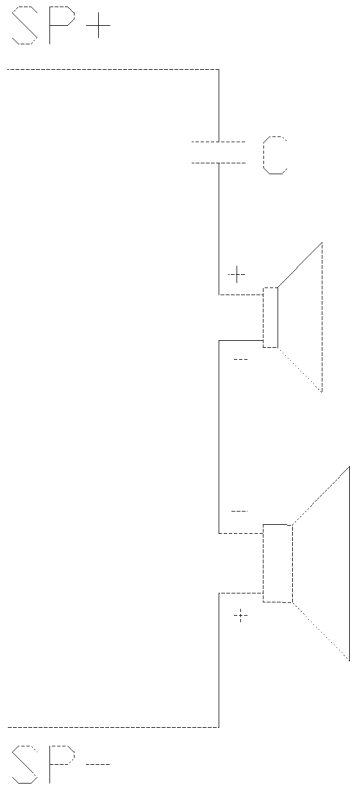
FIG. 6 is a circuit structure diagram according to a sixth embodiment of the present disclosure.

As shown in FIG. 6, each earphone unit in the present embodiment may include a first speaker, a second speaker, and a capacitor C. The first speaker and the second speaker are in reverse connection according to polarity. The positive pole of the first speaker may be connected to one end of the capacitor C, and the negative pole of the first speaker may be connected to the negative pole of the second speaker. The positive pole of the second speaker may be connected to one end (SP−) of an output signal, and another end of the capacitor C may be connected to another end (SP+) of the output signal.

In the above embodiments, the sound playing direction of the first speaker, the sound playing direction of the second speaker, and the sound playing direction of the third speaker are all the same or opposite. FIG. 5 shows a situation where the directions are the same.

Figure 7:
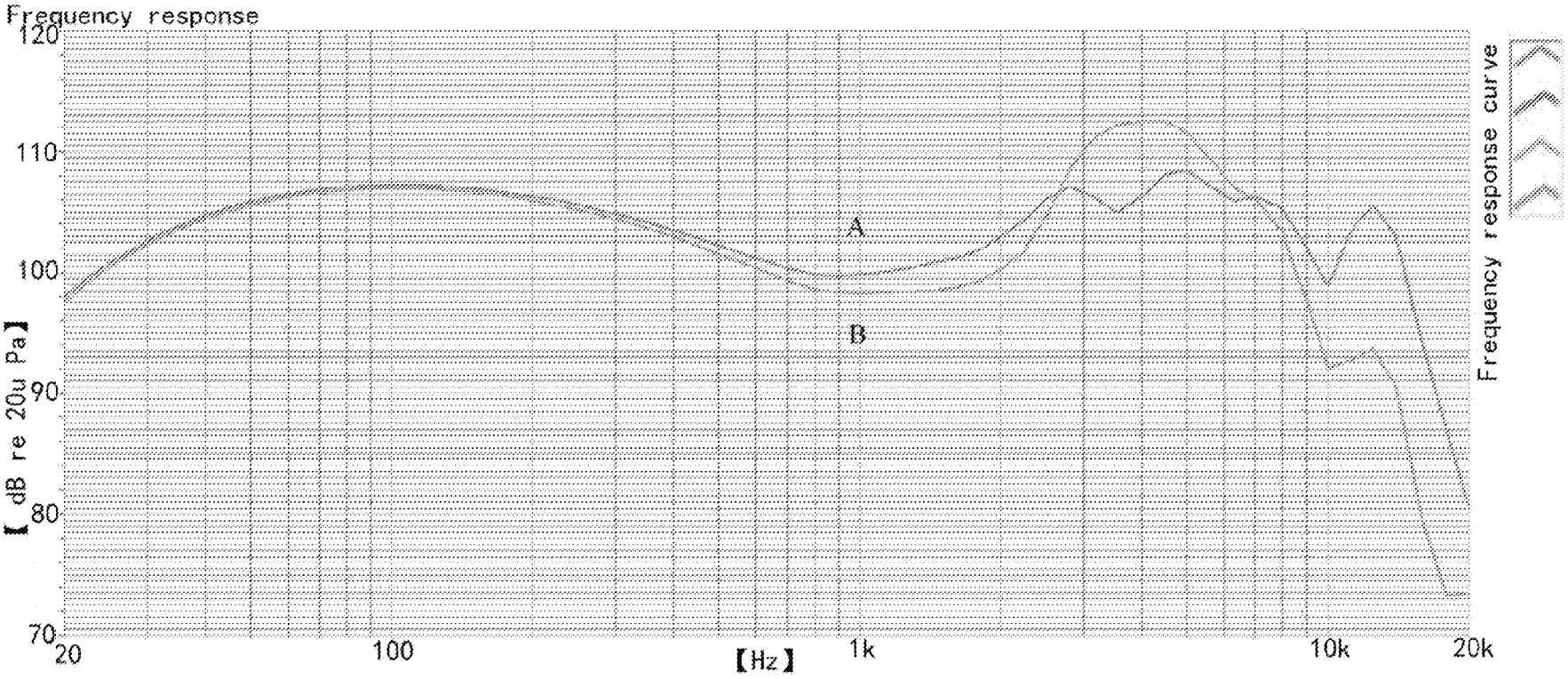
FIG. 7 is a sound effect diagram of the speakers in straight connection and in reverse connection.

The present disclosure uses two speakers, and the two speakers are in reverse connection according to polarity. This can achieve better sound effect. FIG. 7 shows the sound effect of the speaker earphone of the present disclosure, wherein "a" in FIG. 7 is the sound effect of two speakers in straight connection, and "b" is the sound effect of two speakers in reverse connection.

A person skilled in the art can make various other corresponding changes and modifications according to the technical solution and concept described above, and all of these changes and modifications should fall within the scope of protection of the claims of the present disclosure.

What is claimed is:

1. A speaker earphone, comprising at least one earphone unit, each earphone unit comprises a first speaker group or a second speaker group, the first speaker group comprising a first speaker, a second speaker, and at least one capacitor connected between the first speaker and the second speaker, and the second speaker group comprising a first speaker, a second speaker, a third speaker, and at least one capacitor;

in the first speaker group, the first speaker and the second speaker are connected in series to form a series branch, or the first speaker and the second speaker are in reverse-parallel connection to form a parallel branch; one end of the series branch is connected to one end of an output signal, another end of the output signal is connected between the first speaker and the second speaker, another end of the series branch is connected to the one end of the output signal; or the parallel branch is connected to both ends of the output signal, and the capacitor is connected between a positive pole of the first speaker and a negative pole of the second speaker in the parallel branch;

in the second speaker group, the first speaker, the second speaker, and the third speaker are sequentially connected in series to form a series branch, or the first speaker, the second speaker, and the third speaker are sequentially connected in reverse-parallel pairs to form a parallel branch; one end of the series branch is connected to one end of the output signal, another end of the output signal is connected to a negative pole of the first speaker, and connected to a positive pole of the second speaker through the capacitor, another end of the series branch is connected to the one end of the output signal; or the parallel branch is connected to both ends of the output signal, and the capacitor is connected between a positive pole of the first speaker and a negative pole of the second speaker.

2. The speaker earphone according to claim 1, wherein the number of the earphone unit is one.

3. The speaker earphone according to claim 1, wherein, in the first speaker group, when the first speaker and the second speaker form the series branch, a sound playing direction of the first speaker and a sound playing direction of the second speaker are the same.

4. The speaker earphone according to claim 1, wherein, in the first speaker group, when the first speaker and the second speaker are inversely connected to form the parallel branch, a sound playing direction of the first speaker and a sound playing direction of the second speaker are the same orientation or opposite orientation.

5. The speaker earphone according to claim 3, wherein, in the first speaker group, when the first speaker and the second speaker are inversely connected to form the parallel branch, the sound playing direction of the first speaker and the sound playing direction of the second speaker are the same orientation or opposite orientation.

6. The speaker earphone according to claim 1, wherein, in the second speaker group, when the first speaker, the second speaker and the third speaker are sequentially connected in series to form the series branch, a sound playing direction of the first speaker, a sound playing direction of the second speaker, and a sound playing direction of the third speaker are all the same.

7. The speaker earphone according to claim 1, wherein, in the second speaker group, when the first speaker, the second speaker and the third speaker are sequentially connected in reverse-parallel pairs to form the parallel branch, a sound playing direction of the first speaker, a sound playing direction of the second speaker, and a sound playing direction of the third speaker are all the same orientation or opposite orientation.

8. The speaker earphone according to claim 6, wherein, in the second speaker group, when the first speaker, the second speaker and the third speaker are sequentially connected in reverse-parallel pairs to form the parallel branch, the sound playing direction of the first speaker, the sound playing direction of the second speaker, and the sound playing direction of the third speaker are all the same orientation or opposite orientation.

* * * * *